US006901714B2

(12) United States Patent
Liapi

(10) Patent No.: US 6,901,714 B2
(45) Date of Patent: Jun. 7, 2005

(54) TENSEGRITY UNIT, STRUCTURE AND METHOD FOR CONSTRUCTION

(75) Inventor: Katherine A. Liapi, Austin, TX (US)

(73) Assignee: Board of Regents, The University of Texas Systems, Austin, TX (US)

( * ) Notice: Subject to any disclaimer, the term of this patent is extended or adjusted under 35 U.S.C. 154(b) by 51 days.

(21) Appl. No.: 10/157,776

(22) Filed: May 29, 2002

(65) Prior Publication Data

US 2003/0009974 A1 Jan. 16, 2003

Related U.S. Application Data

(60) Provisional application No. 60/294,427, filed on May 29, 2001.

(51) Int. Cl.[7] ..... E04H 12/18

(52) U.S. Cl. ..... 52/645; 52/109; 52/649.5; 52/DIG. 10; 52/648.1; 52/80.2; 52/108; 343/915; 343/916

(58) Field of Search ..... 52/81.1, 81.3, 52/81.2, 81.4, 109, 645, 649.5, DIG. 10, 646, 648.1, 110; 135/108; 343/915, 916

(56) References Cited

U.S. PATENT DOCUMENTS

| | | | | |
|---|---|---|---|---|
| 3,063,521 A | | 11/1962 | Fuller | |
| 3,354,591 A | | 11/1967 | Fuller | |
| 3,710,806 A | * | 1/1973 | Kelly et al. | 135/145 |
| 3,866,366 A | | 2/1975 | Fuller | |
| 4,207,715 A | | 6/1980 | Kitrick | |
| 4,251,969 A | | 2/1981 | Bains | |
| 4,290,244 A | * | 9/1981 | Zeigler | 52/81.3 |
| 4,527,166 A | * | 7/1985 | Luly | 343/840 |
| 5,040,349 A | | 8/1991 | Onoda et al. | |
| 5,230,196 A | * | 7/1993 | Zeigler | 52/646 |
| 5,642,590 A | | 7/1997 | Skelton | |
| 6,542,132 B2 | * | 4/2003 | Stern | 343/915 |
| 2002/0002807 A1 | * | 1/2002 | Newland | 52/645 |
| 2003/0101663 A1 | * | 6/2003 | Boots | 52/81.3 |

OTHER PUBLICATIONS

Duffy et al., "A Review of a Family of Self–Deploying Tensegrity Structures with Elastic Ties," The Shock and Vibration Digest, vol. 32, Mar. 2000, pp. 100–106.

Motro, "Tensegrity Systems and Geodesic Domes," International Journal of Space Structures, vol. 5, Nos. 3&4, 1990, pp. 341–351.

Hanaor, "Double–Layer Tensegrity Grids as Deployable Structures," International Journal of Space Structures, vol. 8, Nos. 1&2, 1993, pp. 135–143.

Hanaor, "Aspects of Double–Layer Tensegrity Domes," International Journal of Space Structures, vol. 7, No. 2, 1992, pp. 101–113.

(Continued)

*Primary Examiner*—Carl D. Friedman
*Assistant Examiner*—Chi Q. Nguyen
(74) *Attorney, Agent, or Firm*—Myertons, Hood, Kivlin, Kowert & Goetzel, P.C.; Eric B. Myertons

(57) ABSTRACT

Tensegrity units may be used to form a tensegrity structure. Each tensegrity unit may include n face tension members, n continuous tension members, and n compression members. A bracket for the tensegrity unit may allow for adjustment of position of portions of the tension members when the tensegrity unit is not in a deployed state. The tension members may be coupled to the tensegrity unit so that there are no loose tension member ends. The unit may be deployed from a collapsed state by positioning the compression members and tension members in a proper orientation and adjusting the length of at least one compression member. Adjusting the length of at least the one compression member may allow tension to be applied to each tension member. A tensegrity structure may be formed from tensegrity units by joining a number of tensegrity units together.

77 Claims, 7 Drawing Sheets

OTHER PUBLICATIONS

Wang et al. "Integral–Tension Research in Double–Layer Tensegrity Grids," International Journal of Space Structures, vol. 11, No. 4, 1996, pp. 349–355.

Wang et al., "From Tensegrity Grids to Cable–strut Grids," International Journal of Space Structures, vol. 16, No. 4, 2001, pp. 279–314.

Bouderbala et al., "Folding Tensegrity Systems," International Colloquium on Structural Morphology—Toward the New Millenium, Aug. 15–17, 1997, Nottingham, pp. 115–122.

Emmerich, "Emmerich on Self–Tensioning Structures," International Journal of Space Structures, vol. 11, Nos. 1&2, 1996, pp. 29–36.

Fest et al., "Adjustable Tensegrity Structures," Journal of Structural Engineering, Apr. 2003, pp. 515–526.

Chassagnoux, "Shaping of tensegrity structures," Structural Morphology Colloquium International Association for Shell and Spatial Structures (IASS), Proceedings, Aug, 16–19, 2000, Delft, Netherlands, pp. 188–193.

* cited by examiner

TENSEGRITY UNIT, STRUCTURE AND METHOD FOR CONSTRUCTION

PRIORITY CLAIM

This application claims priority to U.S. Provisional Application No. 60/294,427 entitled "Tensegrity Unit, Structure and Method for Construction," filed May 29, 2001. The above-referenced provisional application is hereby incorporated by reference as if fully set forth herein.

BACKGROUND OF THE INVENTION

1. Field of the Invention

The present invention relates generally to a tensegrity structure. An embodiment of the invention relates to a tensegrity unit that has no loose bars or cables in a collapsed state, and that may be easily and rapidly deployed. Several tensegrity units may be coupled together to assemble a tensegrity structure.

2. Description of Related Art

A tensegrity unit is a self-stressed equilibrium network in which a continuum of tension members (e.g., cables) interacts with a discontinuous system of compression members (e.g., bars) to provide the unit with structural integrity. The tension members may be cables, lines, chains, or other similar devices that sustain tension forces. A continuum of tension members means that tension members may directly interact with, or be coupled to, other tension members. A discontinuous system of compression members means that compression members may not directly interact with, or be coupled to, other compression members. The compression members may be rigid members such as bars, poles, rods, or other similar devices that are capable of sustaining compressive forces. Tensile forces rather than compressive forces may primarily provide structural integrity (i.e., shape, strength, etc.) in a tensegrity structure, Compression members and tension members may form a tensegrity unit. A simple tensegrity unit may be a polyhedron formed of two base polygons held apart from one another. The tensegrity unit may have a skewed prism shape when deployed. For example, 2n tension members may define the edges of a first and second base polygon, where n is the number of vertices in each polygon. Each base polygon may be a basic geometric shape such as a triangle, square, rectangle, trapezoid, etc. The first and second polygons may be similar in size, or the first and second polygons may have different sizes. The first and second base polygons may be spaced apart by n compression members. Compression members may be positioned along diagonals joining vertices of the first base polygon to the second base polygon. An additional n tension members may join corresponding vertices of the first and second base polygons. In such an arrangement, 3n tension members are needed to form a tensegrity unit.

FIG. 1*a* depicts one type of tensegrity unit. Tensegrity unit 10 has three compression members 12 and nine tension members. The tension members include three separate upper tension members 14, three separate lower tension members 16, and three separate side tension members 18. Tensegrity unit 11 of FIG. 1*b* has four compression members 13 and twelve tension members 15. Thus, tensegrity units 10 and 11 both have n compression members and 3n tension members.

Tensegrity units may be joined to form tensegrity systems or structures. A tensegrity system may form a three-dimensional structure such as a dome, tower, etc. The geometry of a tensegrity system may depend on the geometric configuration of the individual tensegrity units of the system and the way the units are coupled together.

Tensegrity structures may be collapsible and/or deployable. Releasing tension in a tensegrity unit may allow compression members to collapse into substantially the same plane. In such a configuration, a tensegrity unit may have no rigid structure. When collapsed, the total size of a tensegrity unit may be minimized. Tension may be applied to tension members of a tensegrity unit to deploy the tensegrity unit.

A tensegrity structure may be created so that removing tension from at least some tension members allows the entire structure to be folded for storage, transport, etc. A collapsed tensegrity structure could be deployed by applying tension to appropriate tension members. In practice, a collapsible/deployable tensegrity structure formed by joining tensegrity units in 2 directions has been elusive. For structures of significant size, issues such as tangling of tension members and collisions between compression members may become quite difficult to solve.

A number of tensegrity units may be joined together to form a tensegrity structure or tensegrity network. Individual tensegrity units may be coupled together in at least two different ways. Tensegrity units may be interlaced so that compression member independence is maintained throughout the structure. One way to maintain compression member independence is to couple an end of a compression member of a first unit to a tension member of a second unit. Joints of this type of union may be relatively simple, and worn parts may be easily replaceable. Maintenance may also be reduced due to wear on joints being minimized. It is believed that wear may be minimized on joints of this configuration due to the lack of friction between compression members. Methods for forming a tensegrity structure are disclosed in U.S. Pat. Nos. 3,354,591 and 3,063,521 to Fuller, both of which are incorporated by reference as if fully set forth herein.

Tensegrity structures with no compression member-to-compression member connections may be geometrically deformable. Such structures may be relatively insensitive to inaccuracies in tension member lengths and/or compression member lengths. In some other types of deployable structures, such as scissor structures, minor inaccuracies in tension member lengths and/or compression member lengths may significantly affect structure assembly and load bearing ability.

A second way to assemble tensegrity units together involves attaching tensegrity units together at nodes (or vertices) so that there is a compression member-to-compression member connection. This type of connection only partially conforms to the definition of tensegrity since compression member independence is lost. Such connections may require complex joints if the resulting structure is intended to be collapsible. Rigid connection of compression members may inhibit structure collapse. U.S. Pat. No. 5,642,590 to Skelton, which is incorporated by reference as if fully set forth herein, discloses a tensegrity structure utilizing compression member-to-compression member connections.

Tensegrity structures may possess a high level of structural redundancy. The structural redundancy may inhibit collapse of the tensegrity structure if one or several units should fail. The tensegrity structure may retain a large percentage of load bearing capacity even if one or more members fail.

Two methods have been used to deploy tensegrity units. Deploying a tensegrity unit may include expanding the unit and establishing static equilibrium between the members of the unit such that the unit remains in the expanded state. For example, tensegrity unit 10 in FIG. 1*a* may be deployed by decreasing the length of one or more of tension members 14, 16, 18 or by increasing the length of one or more of compression members 12. In each of these methods, other steps may also be required, such as positioning the members before applying tension. Likewise, collapsing tensegrity unit 10 may be accomplished by releasing tension in the unit. Methods to collapse tensegrity unit 10 may include increasing the length of one or more tension members 14, 16, 18, or decreasing the length of one or more compression members 12.

Experiments were conducted to determine differences between deploying/collapsing tensegrity units having n compression members and 3n tension members by adjusting tension members and by adjusting compression members. Small-scale triangular based and square based tensegrity units were examined. For one set of experiments, the lengths of compression members (bars) were kept constant while the lengths of tension members (cables) could be modified. The results indicated that releasing the cables in different sequences resulted in different modes of collapsing the unit. In general, by releasing the cables on the top base of the unit first, the unit tends to collapse on its support plane (e.g., the ground). As the unit collapses, the bars may take a turn around an axis of symmetry of the original unit. Packaging a unit in a compact configuration may require that all bars be carefully aligned after collapse to avoid entanglement with loose cables. Aligning bars in this manner may be difficult to achieve with the unit on the ground, especially since the bars tend to collapse in a symmetric pattern around the center of the unit.

When side cables are released first, tension from cables push the collapsing unit to an upright position. With careful handling, bars may be held together so that, when all the cables that allow for the complete collapse of the unit are released, the bars remain parallel to each other. The unit may then be packaged in a bundle. Care must be taken with loose ends of released tension members to avoid tangling of the tension members. Positioning the compression members and the tension members and setting the final tension member may be tedious and difficult when the unit is redeployed. Applying tension may require special tools.

Experiments were conducted using scale models of two curved tensegrity structures composed of three and nine units, respectively. The units had triangular bases. These structures were allowed to collapse by systematically releasing cables. Results indicated that the collapse of the entire structure by releasing only side cables was not possible because of the synergetic action of the units. To collapse the structure, it was necessary to release both side and top cables. The structure collapsed on its support plane in a symmetric but complex configuration. Packaging the collapsed structure in a bundle from this configuration was cumbersome. Deploying the collapsed structure to its initial geometry was even more difficult due to frequent cable entanglement. In addition, it is believed that for a full-scale structure of either of these configurations, collision of bars and the total weight of the structure may pose significant burdens to the application of the method.

Triangular base units with telescoping bars were used to examine collapse behavior of tensegrity units by adjusting lengths of compression members. The lengths of tension member cables were kept constant. The cables were permanently attached to the bars. When the bar length was reduced so that it became the same length or slightly shorter than the side cable length, the unit lost its rigidity but did not entirely collapse on the ground. During the process, if the bars were held together, the unit could collapse to an upright or vertical position. In the collapsed configuration, side cables could be kept almost straight, possibly reducing the likelihood of entanglement. Shortening or elongation of the telescopic bars, the length of which were manually controlled, however, required locking and unlocking of each bar. In addition, when deploying the unit, locking the last bar in place to establish appropriate tension in the unit was difficult with considerable tension already present within the unit.

SUMMARY OF THE INVENTION

A tensegrity unit may be formed of compression members and tension members. In a deployed state, the tensegrity unit may be coupled to other tensegrity units to form a tensegrity structure. In a non-deployed state, the compression members may be easily positioned in a compact bundle. In the non-deployed state, the tension members may remain coupled to compression members and/or to brackets so that there are no loose tension member ends that may become tangled.

A tensegrity unit may be described as having vertices, faces, and edges; however, it is to be understood that in some cases these terms may not refer to physical structure. A "vertex" or "node" is an intersection of several tension members and at least one compression member. A vertex or node may be a region instead of a point. A "face" is a plane passing through three or more nodes such that the planar surface defines a boundary of the tensegrity unit. End faces may have irregular or polygonal shapes such as, but not limited to, triangles, rectangles (squares), pentagons, or hexagons. Side faces of a tensegrity unit may have irregular shapes. An "edge" may be formed by a tension member, or by an imaginary line formed between two vertices that could be joined by a tension member.

In an embodiment of a tensegrity unit, the unit is formed of n compression members and 2n tension members. Compression members may have brackets that hold tension members. One or more of the compression members may have adjustable lengths. Also, one or more of the compression members may include a slot, a clamp, or other type of connector that allows the unit to be coupled to another tensegrity unit. Tension members may have fixed lengths. The unit may be assembled so that ends of the tension members are not free when the unit is collapsed (non-deployed), when the unit is being collapsed or deployed, or when the unit is deployed.

In an embodiment, one base polygon or end face may be formed by n tension members. The remaining n tension members may form a second base polygon and sides of the tensegrity unit. A "side" of a tensegrity unit may be defined as an edge of a polyhedron formed by the deployed tensegrity unit between the base polygons. Generally, the tension members forming a side are not coplanar. Thus, n tension members may form both the sides and a polygonal base of the unit. Base polygons may be spaced apart by n compression members. The n tension members that form both a side and a face are hereinafter referred to as "continuous tension members;" whereas the n tension members that form only a face are hereinafter referred to as "face tension members". The n continuous tension members may be coupled to the n compression members by n brackets at a point along the length of the continuous members. At their ends, the face and continuous tension members may be coupled to compression members by coupling members. Coupling members may include, but are not limited to welds, loops, links, hooks, and/or carabiners.

In an embodiment, a structure may be formed by coupling tensegrity units together. In an embodiment, a tensegrity unit may be joined by coupling a vertex of one tensegrity unit to a tension member of another unit. Typically, a vertex of a tensegrity unit is coupled to a face tension member of a second tensegrity unit, or to a portion of a continuous tension member that defines a base polygon of a second tensegrity unit. A tensegrity unit may also be coupled to a portion of a continuous tension member that defines an edge of a second tensegrity unit. A tensegrity unit may be coupled to one or more additional tensegrity units.

To form a tensegrity structure, several individual tensegrity units may be separately deployed. Then, the individual tensegrity units may be joined together to form the tensegrity structure. Deploying a tensegrity unit may be defined as establishing a condition in which the compression members are not parallel, and are retained in static equilibrium with the tension members. In an embodiment, a tensegrity structure may be constructed from the top down. That is, the uppermost portion of the structure may be constructed first. As the structure is assembled, it may be raised. In such an embodiment, substantially all construction activity may take place at the same level (e.g., ground level).

BRIEF DESCRIPTION OF THE DRAWINGS

Advantages of the present invention will become apparent to those skilled in the art with the benefit of the following detailed description of the preferred embodiments and upon reference to the accompanying drawings in which.

Figure 1A:
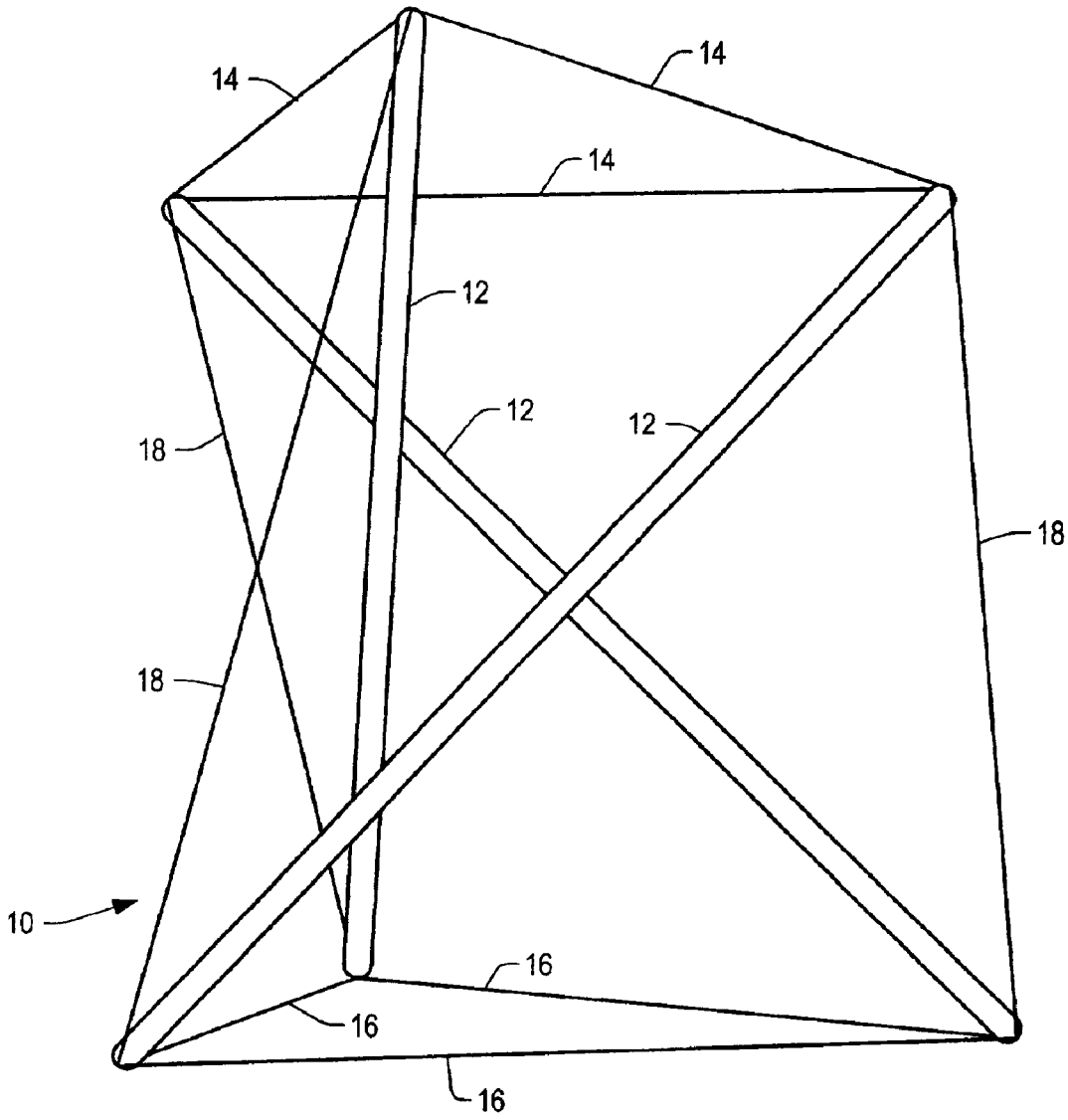
FIG. 1*a* depicts a perspective representation of a deployed tensegrity unit, wherein the tensegrity unit includes three compression members and nine separate tension members.
Figure 1B:
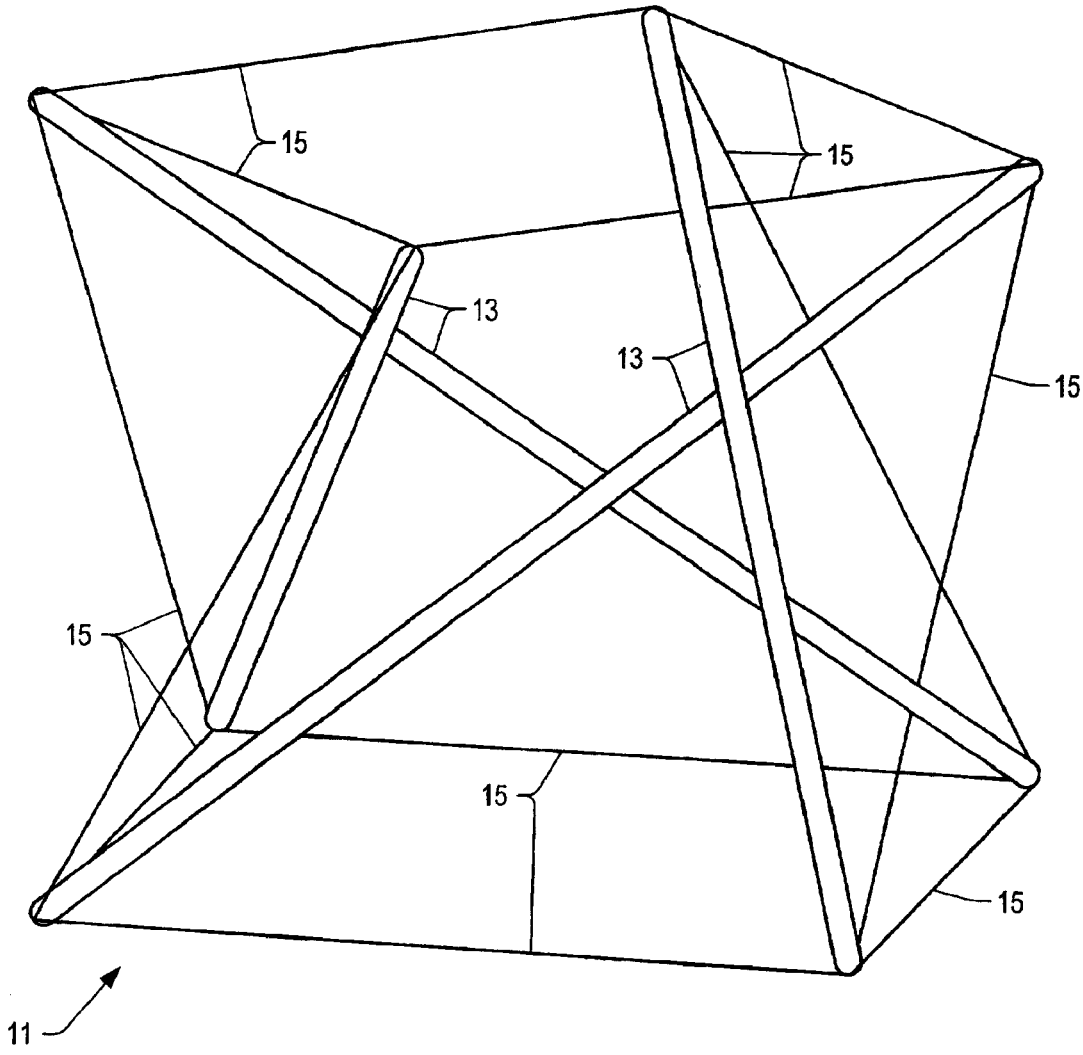
FIG. 1*b* depicts a perspective representation of a deployed tensegrity unit, wherein the tensegrity unit includes four compression members and twelve separate tension members.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION OF PREFERRED EMBODIMENTS

Several basic functionality requirements may be desirable in a tensegrity unit. Desirable functionality requirements may include:

1) the number of steps in the deployment and/or collapse of the unit, including the number of joints that require manual control, should be kept to a minimum;

2) the deployment and/or collapse process should not involve loose cable ends;

3) the deployment and/or collapse should not require tension member length change; an 4) the unit should collapse as a bundle in an upright position.

Figure 2:
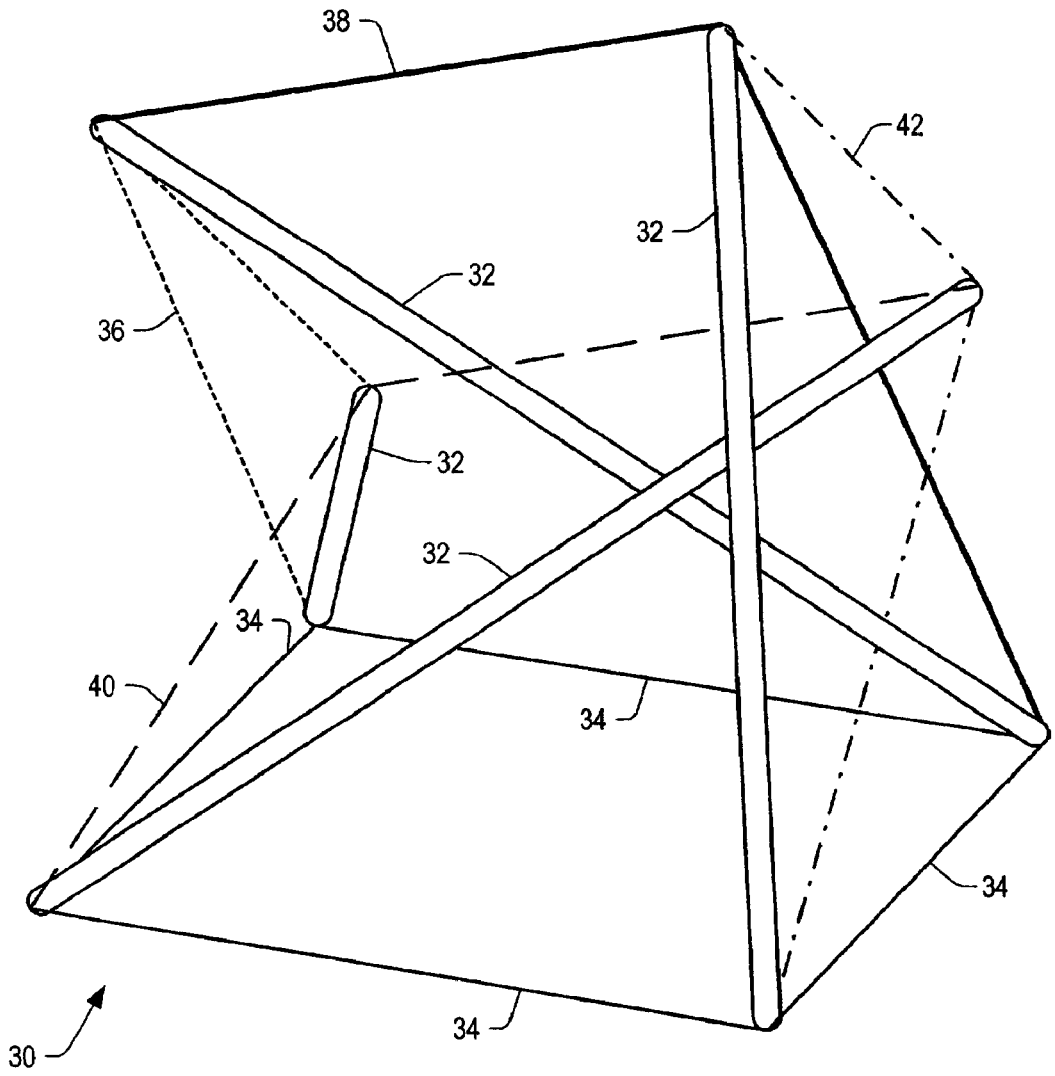
FIG. 2 depicts a perspective view of an embodiment of a deployed tensegrity unit, wherein the tensegrity unit includes four compression members and eight tension members.

FIG. 2 depicts an embodiment of tensegrity unit 30. Tensegrity unit 30 may include compression members 32, face tension members 34, and continuous tension members 36 (dotted line), 38 (bold line), 40 (dashed line), and 42 (alternating dotted and dashed line). Tensegrity unit 30 may have a skewed prism geometric shape. The amount of skew may depend on the number of compression members in the tensegrity unit. For example, a tensegrity unit having three compression members may have about 30° of skew between an upper face that is parallel to a lower face, while a tensegrity unit having four compression members may have about 45° of skew between an upper face that is parallel to a lower face.

Tensegrity units may be joined together to form a tensegrity structure. The tensegrity structure may be formed, but is not limited to being formed, in a curved shape or a tiered shape. In an embodiment, tensegrity units are coupled together so that no compression members of the tensegrity structure contact other compression members of the structure. A covering may be placed over the tensegrity structure. The covered tensegrity structure may be used, but is not limited to being used, as a shelter, a storage area, or a three-dimensional structural form.

As shown in FIG. 2, tensegrity unit 30 may have n compression members 32; n continuous tension members 36, 38, 40, and 42; and n face tension members 34, where n=4. The tensegrity unit has n fewer tension members than a tensegrity unit that uses two sets of face tension members and a set of connecting tension members.

Figure 3:
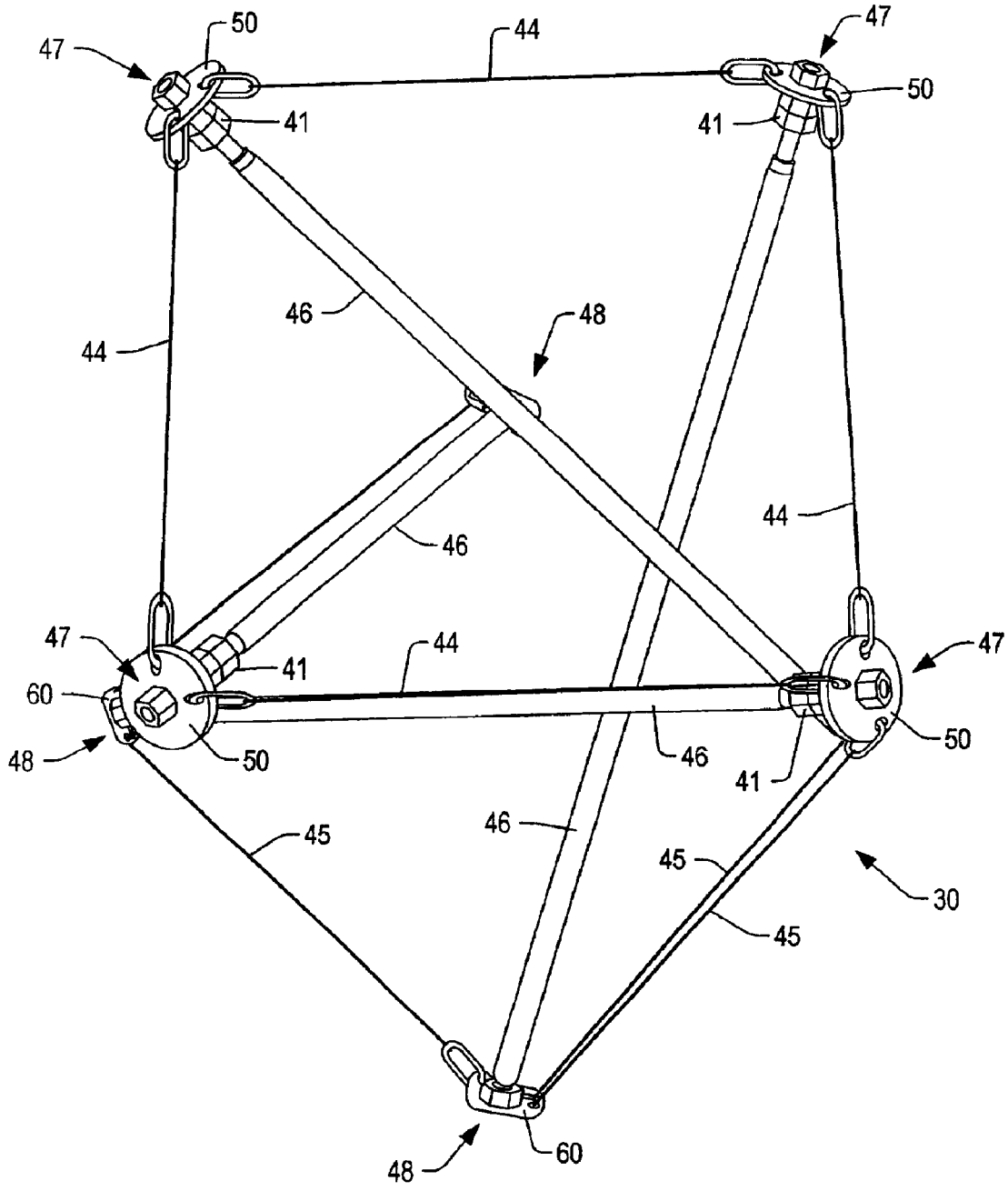
FIG. 3 depicts a perspective view of an embodiment of a deployed tensegrity unit, wherein the tensegrity unit includes four compression members and eight tension members.

FIG. 3 depicts an embodiment of tensegrity unit 30. Tensegrity unit 30 may include continuous tension members 45 (two of which cannot be seen in FIG. 3), face tension members 44, compression members 46, and vertices 47 and 48. Tensegrity unit 30 may be provided with coupling devices (also shown in FIGS. 3 and 5) at each vertex 47 and 48 to allow tension members to be coupled to compression members. Tensegrity unit 30 may further include a connector (shown in FIG. 5) at one or more vertices to allow individual tensegrity units to be coupled together.

In an embodiment, tension members 44, 45 may have fixed lengths. Tension members 44, 45 may be, but are not limited to, chains, cables, and/or ropes. In some embodiments, an attachment device may facilitate coupling tension members 44, 45 to compression members 46. An attachment device may be, but is not limited to, a loop, a link, a hook, a clip, and/or a carabiner. In some embodiments, tension members 44, 45 may be crimped, glued, welded, or otherwise affixed to compression members 46.

Compression members 46 may have an adjustable length. Compression members 46 may include length-adjusting device 41. For example, length-adjusting device 41 may be a pneumatic, hydraulic, or mechanical device that allows the length of compression members 46 to be adjusted. To deploy tensegrity unit 30, length-adjusting device 41 may be employed to lengthen one or more compression members 46 to establish appropriate tension in tensegrity unit 30. To collapse tensegrity unit 30, length-adjusting device 41 may be employed to shorten one or more compression members 46 to remove tension from tensegrity unit 30. In some embodiments, specialized tools (e.g., an air compressor, pneumatic pump, etc.) may be required to deploy tensegrity unit 30. In other embodiments, however, length-adjusting device 41 may allow the length of compression members 46 to be adjusted without the use of specialized tools. For example, length-adjusting device 41 may require no tools. Alternatively, a standard wrench, a lever, or other common hand-held tools may be required for adjusting the length of compression members 46.

In some embodiments, coupling devices 50 may be provided to couple tension members 44, 45 to compression members 46 near vertices 47. Coupling devices 50 may allow tension members 44, 45 to be removed and replaced easily during maintenance of a tensegrity unit. Coupling devices may be, but are not limited to, bolts, pins, rings, turnbuckles, and/or openable links. Coupling devices 50 may align the tension components of force of each coupled tension member 44 and 45 so that the tension components of force coincide at the axis of compression member 46 to which they are attached. However, there is sufficient flexibility in the tensegrity unit structure to allow for some variation in this constraint. In some embodiments, coupling devices 50 may be rotated around the axis of a compression member 46 in the event that the tension components of force unacceptably deviate from the axis.

Figure 6:
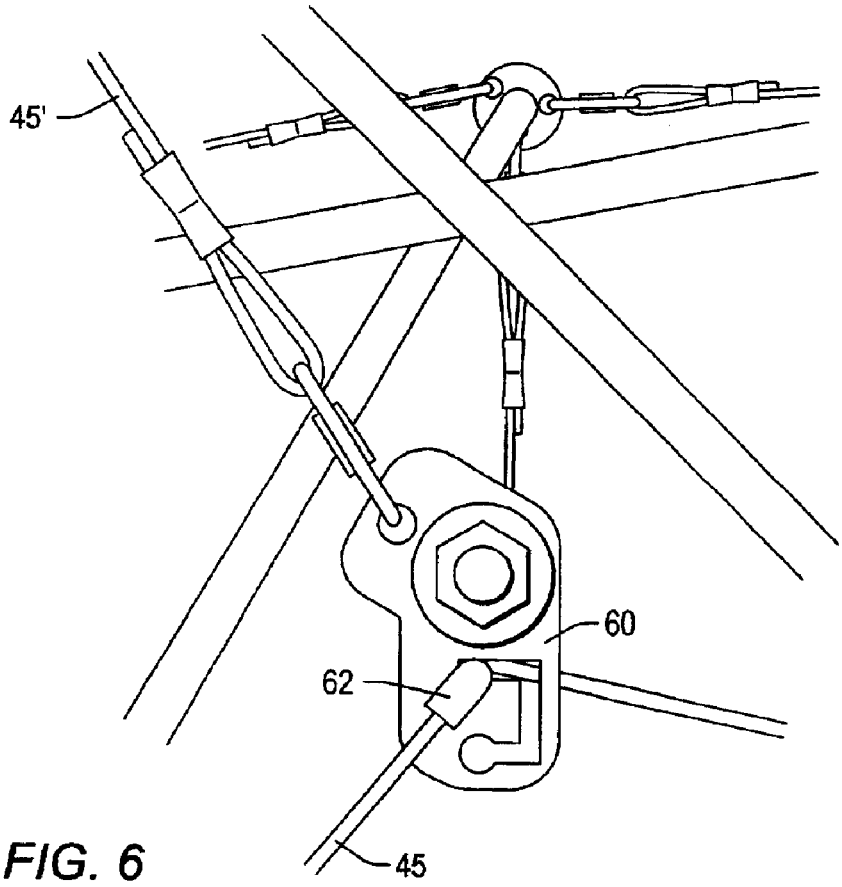
FIG. 6 depicts a perspective view of an embodiment of a tensegrity unit that emphasizes a bracket of the tensegrity unit.

In an embodiment, bracket 60 may be provided to couple continuous tension members 45 to compression members 46 at vertices 48. An end of a continuous tension member may be coupled to bracket 60. A mid portion of a different continuous tension member may also couple to the same bracket when the tensegrity unit is deployed. When tensegrity unit 30 is not deployed, a portion of the continuous tension member may be able to move relative to the bracket. When tensegrity unit 30 is deployed, bracket 60 may retain continuous tension member 45 at vertex 48. A bend in continuous tension member 45 may be formed at bracket 60, effectively dividing continuous tension member 45 into a face tension member and a side tension member. Continuous tension member 45 may include stop 62, as shown in FIG. 6. Stop 62 may be fixed at a predetermined location along the length of continuous tension member 45. Stop 62 may be a clip, ball, bead, or other device which creates an enlargement in continuous tension member 45 that is prevented from passing through an opening in bracket 60 of a smaller size than the stop.

Figure 6A:
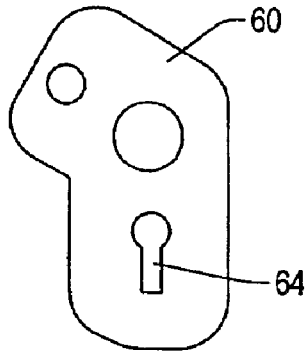
FIG. 6*a* depicts a front view of an embodiment of a bracket with a linear elongated opening.

Bracket 60 may be provided with an elongated opening 64 of variable width. In some embodiments, the elongated opening may be U shaped (as shown in FIG. 6). In some embodiments, elongated opening 64 may be a linear opening (as shown in FIG. 6*a*). Other opening orientations may also be used. The orientation of the bracket relative to the compression member and the tension members may maintain the tension members in the appropriate portion of the opening during use. Elongated opening 64 may allow continuous tension member 45 to move axially with respect to compression member 46 when tensegrity unit 30 is not under tension, but may retain continuous tension member 45 at a fixed location with respect to compression member 46 at vertex 48 when tensegrity unit 30 is under tension. In addition, elongated opening 64 may have an enlargement in its width sufficient to allow stop 62 to pass through bracket 60. The enlargement in the opening of bracket 60 may allow a portion of continuous tension member 45 to move relative to the bracket when tensegrity unit 30 is not under tension so that tension members of the tensegrity unit may be located at desired positions when the tensegrity unit is stored. Such an embodiment may reduce incidences of tension member entanglement by retaining the ends of tension members 45 and 45' at desired locations. Using continuous tension members that function as both face and side tension members may allow tension to be released on one side and one face of tensegrity unit 30 substantially simultaneously. Releasing tension in this manner may allow tensegrity unit 30 to collapse in a vertical collapsed mode. Like coupling device 50, bracket 60 may be able to rotate around an axis of compression member 46.

In an embodiment of a tensegrity unit, the portions of the tensegrity unit may be assembled together without tension applied to the tension members. Coupling devices may be placed on ends of compression members. Brackets may be placed on opposite ends of the compression members. Face tension members may be connected to the coupling devices so that the face tension members will form a lower face when the tensegrity unit is deployed. One end of a continuous tension member may be coupled to a coupling device. The tension member may be inserted through the elongated opening in the bracket of the appropriate compression member. The large opening in the bracket may facilitate inserting the tension member through the bracket. The second end of the continuous tension member may be connected to the appropriate bracket. In some embodiments, the tension members may be fixed to the coupling devices and the brackets (e.g., connecting links may be fused) to inhibit disassembly of the components of the tensegrity unit.

Figure 4:
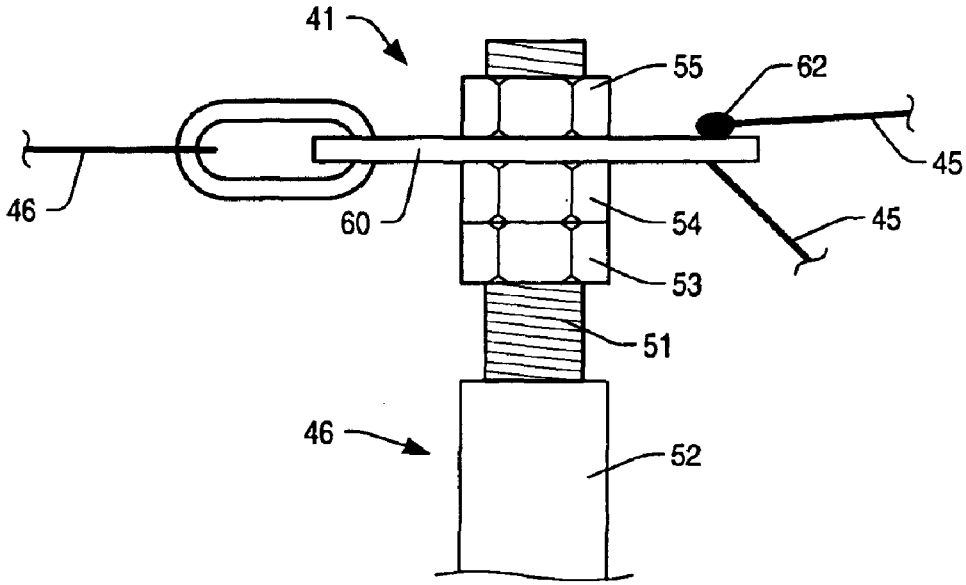
FIG. 4 depicts an embodiment of a portion of a compression member.

In an embodiment of a compression member, a threaded shank may be placed in an end or each end of a compression member body. FIG. 4 depicts an end of compression member 46 that includes threaded shank 51. In some embodiments, threaded shank 51 may be locked against body 52 of compression member 46. Threaded shank 51 may be locked against body 52, but is not limited to being locked against the body, by a nut, adhesive, and/or tack welding. In some embodiments, threaded shank 51 may be allowed to move into or out of the body of the compression member to allow for adjustment of length of the compression member. A threaded shank may function as a portion of length-adjusting device 41 of compression member 46.

In some compression member embodiments where the threaded shank is locked in position relative to the body of the compression member a system of nuts may allow for adjustment of the length of the compression member to increase or decrease tension applied to continuous tension members. In an embodiment, first nut 53 may be threaded onto shank 51. Second nut 54 may also be threaded onto shank 51. Bracket 60 may be placed on top of second nut 54. Third nut 55 may be threaded onto shank 51 to position bracket 60 between second nut 54 and the third nut.

To apply tension to continuous tension member 45 to deploy a tensegrity unit, all compression members of the tensegrity unit except one may be set to a desired length. A length of the compression member that is not set to the desired length may be set a length that is slightly shorter than the length of the other compression members. The shorter length may be established by rotating first nut 53 towards body 52 of compression member 46 (a clockwise direction for a right hand thread) and by rotating second nut 54 towards the first nut. Establishing one compression member with a shorter length may allow sufficient slack in the continuous tension members to allow stops 62 of the continuous tension members to be positioned at locations in the elongated openings of brackets 60 that inhibit passage of the stops through the brackets. When the continuous tension members are properly positioned in the brackets, ends of the compression members with coupling devices may be positioned to form a polygonal lower face of the tensegrity unit. The tensegrity unit should be self supporting at this point, and should only require adjustment of the short compression member to complete the tensegrity unit.

To adjust the short compression member, second nut 54 may be rotated to advance the nut towards third nut 55. If bracket 60 locks between second nut 54 and third nut 55 before sufficient tension is applied to the tension members of the tensegrity unit, the third nut may be rotated to move outwards along shank 51 and the second nut may be advanced to move bracket 60 outwards until sufficient tension is applied to the continuous tension members and the face tension members. When second nut 54 is in the proper position, third nut 55 may be advanced against bracket 60. First nut 53 may be advanced against second nut 54 to fix the position of the second nut.

To release tension from the tension members of a tensegrity unit, first nut 53 may be advanced towards compression member body 52. Second nut 54 may be advanced towards first nut 53. As second nut 54 moves towards first nut 53, tension is released from the tension members. The second nut may be moved a distance sufficient to allow stop of tension member 45 in bracket 60 to be moved to the enlargement or large opening of the bracket that allows passage of stop 62. When stop 62 passes through the large opening, sufficient tension may be released from the tensegrity unit to allow the tensegrity unit to collapse.

Figure 5:
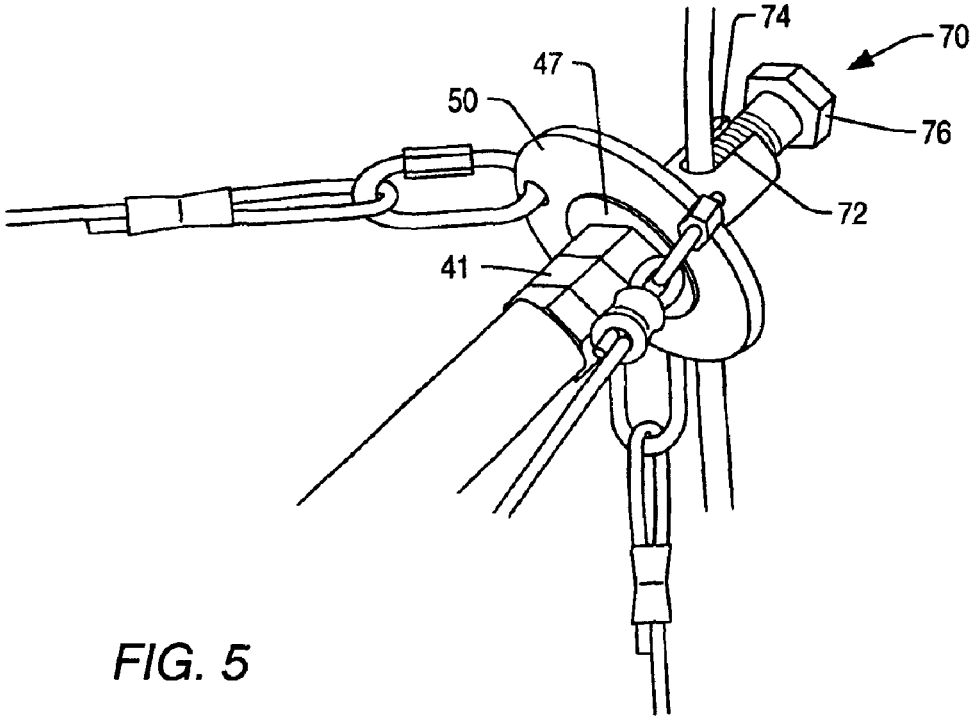
FIG. 5 depicts a perspective view of an embodiment of a tensegrity structure that emphasizes a tensegrity unit-to-tensegrity unit connection.

One or more vertices of tensegrity unit 30 may be provided with a structure-coupling device 70 as shown in FIG. 5. Structure-coupling device 70 may allow two or more tensegrity units 30 to be coupled together. Structure-coupling device 70 may be a clamp that attaches a tension member of a first tensegrity unit to a compression member of a second tensegrity unit. In an embodiment, structure-coupling device 70 may include body 72 with opening 74 and retainer 76. A tension member of a first tensegrity unit may be placed in opening 74 in body 72 of structure-coupling device 70 of a second tensegrity unit. Retainer 76 may engage and/or couple to the tension member within opening 74. Retainer 76 may inhibit the tension member in the opening from moving. In some embodiments, a portion of body 72 that defines opening 74 may include a threaded portion and a non-threaded portion. A tension member may be placed in the non-threaded portion of the body. A threaded retainer may be screwed into the threaded portion until an end of the retainer contacts and inhibits movement of the tensegrity unit with respect to the tension member in the structure-coupling device. In some embodiments, retainer 76 and/or body 72 may include padding, a gasket or some other material that inhibits damage of the tension member by the retainer.

In some embodiments, indicia may be provided on one or more tension members of a tensegrity unit. Indicia may indicate locations or regions at which other tensegrity units are to be coupled to the tensegrity unit with the indicia. The indicia may be paint, ties, string or other type of marking on the tension member.

A tensegrity unit may also be provided with a cover attachment for attaching cover 77 (shown in FIG. 7*b*) to a structure of tensegrity units. In some embodiments, cover 77 may be attached to structure-coupling devices of selected tensegrity units. In other embodiments, separate cover attachments may be attached to tension members and/or compression members of selected tensegrity units. Cover attachments may be, but are not limited to, clips, hooks, and/or ties.

In certain embodiments, tensegrity units may be coupled together in patterns that allow all of the compression members in the structure to remain isolated from one another. In some embodiments, such tensegrity structures may be constructed without the use of specialized equipment. Such tensegrity structures may be particularly suited for use as deployable structures. Deployable structures are structures that may be assembled or constructed quickly at a desired location. A deployable structure may be used as an emergency shelter, hospital, etc., after a disaster. A deployable structure may also be used to house a traveling exhibit or used as a temporary storage facility. In such applications, it may be beneficial for a structure to be portable and easily assembled without the use of specialized tools, and especially without the use of heavy equipment such as cranes.

In some embodiments, a tensegrity structure may be composed of portable components. In some embodiments, a tensegrity structure composed of portable components may be assembled by one person, or only a few people, without the use of specialized tools. A method for constructing such a tensegrity structure may include: deploying at least two tensegrity units; coupling deployed tensegrity units together to form a stable cluster; supporting the stable cluster on at least one support; expanding the structure in a manner which maintains stability; and elevating the structure on one or more supports as required until the final dimension of the structure is attained.

In an embodiment, all of the tensegrity units to be used in the structure may be brought to the site in collapsed, compact bundles. In some embodiments, all of the tensegrity units may be deployed and adjusted for appropriate tension before construction of the structure begins. Deployed units may then be coupled by use of structure-coupling devices. If a structure is to be composed of a large number of units, the structure may be assembled in sections with individual tensegrity units or groups of individual tensegrity units being deployed as needed.

Figure 7A:
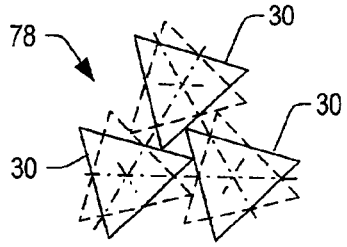
FIG. 7*a* depicts a stable cluster formed of three triangular tensegrity units.

In an embodiment, construction of the structure may start from a geometric center or along an axis of symmetry. A stable cluster composed of a minimum number of tensegrity units may be built on the ground. The number of tensegrity units required for a stable cluster may depend on the geometry of the units and the manner in which the units are coupled together. For example, three tensegrity units 30 may form a stable cluster of units 78 with a triangular base, as show in FIG. 7*a*.

In some embodiments, structure-coupling devices may be located on compression members at ends of the compression members that form a lower face of the tensegrity unit. In some embodiments, structure-coupling devices may be located on compression members at ends of the compression members that form an upper face of the tensegrity unit. In some embodiments, structure-coupling devices may be located on at each end of the compression members.

Figure 7B:
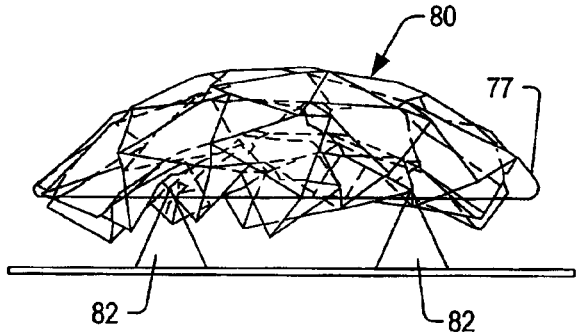
FIGS. 7*b* and 7*c* depict assembly of an embodiment of a tensegrity structure formed by coupling stable triangular clusters.
Figure 7C:
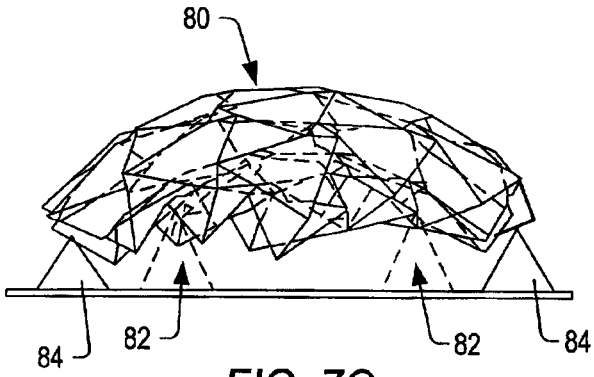
Figure 7D:
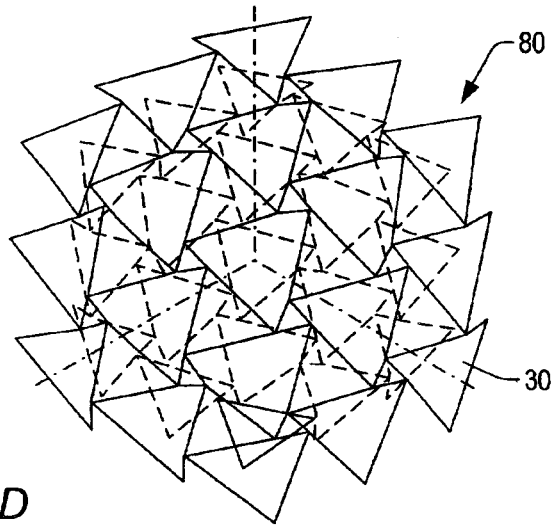
FIG. 7*d* depicts a top view of a tensegrity structure.

In an embodiment illustrated in FIGS. 7*b* and 7*c*, two sets of supports 82 and 84 that may be mechanically expandable in the vertical direction may be used for raising structure 80. The number of supports in each set 82 and 84 may depend on a geometry of tensegrity units 30 and stable clusters 78 formed from the tensegrity units. First set of supports 82 may be used to raise stable cluster 78 approximately the height of tensegrity unit 30. A row of tensegrity units 30 may then be attached to stable cluster 78 by systematically expanding structure 80 in each desired direction, which may be along axes of symmetry. When a new row of tensegrity units 30 has been added to structure 80, second set of supports 84 may be placed along a new periphery of structure 80. Second set of supports 84 may lift structure 80 up about an additional unit height. First set of supports 82 may be removed when second set 84 is securely placed under the new row of added tensegrity units 30. Thus, as the size of structure 80 increases, the supports may be moved towards the new periphery of structure 80. In this manner, structure 80 may continue to increase in height and area. If the last row of structure 80 is to be raised over the ground level, the expandable supports may be replaced by tensegrity unit 30 of the same type or a different type upon completion of the main structure. FIG. 7*d* shows a top view of tensegrity structure 80. If desired, a cover or covers may be coupled to the structure. The cover or covers may be coupled to the structure either as the structure is being assembled or after the structure is assembled.

In an embodiment, the method may be reversed to deconstruct a tensegrity structure. Units may be detached starting from periphery and working towards the center. The structure may gradually be lowered by moving the supports toward the center of the structure as clusters are removed from the periphery of the structure. Individual units may be collapsed into a bundle by releasing tension in the units.

An advantage of the tensegrity units described herein is that they may be easily transported, erected, collapsed, and stored without special skills and without the need for specialized tools. In addition, the deployment and collapse of the tensegrity unit should not require on-site assembly of tensegrity units from separate compression members and tension members. Assembled tensegrity units may be transported to a location. At the location, the tensegrity units may be transformed from a collapsed state to a deployed state. Another advantage is the minimization of the total manual effort required to erect, collapse, and/or maintain a tensegrity unit. Another advantage is that the tensegrity units may be used to construct a deployable structure that is assembled without the use of specialized tools or equipment. Additionally, the disclosed construction method may be advantageous in that it may not require the use of a crane or other heavy construction equipment to lift portions of the structure.

It is believed that constructing the structure in this fashion may be advantageous over previously proposed construction techniques for tensegrity structures in that issues of tension member tangling and compression member collision may be minimized or eliminated. Tensegrity units may be sturdy, durable, light weight, simple, safe, inexpensive, efficient, versatile, ecologically compatible, energy conserving and reliable. The tensegrity units may also be easy to assembly, install, and use.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A tensegrity unit comprising:

n face tension members of fixed length;

n continuous tension members affixed length;

n compression members;

at least one bracket coupled to at least one of the n compression members, and a stop positioned along a length of one of the n continuous tension members, wherein the at least one bracket inhibits passage of the stop through the at least one bracket during use to establish tension in the one of the n continuous tension members; and wherein n is the number of sides of a polygonal face of the tensegrity unit.

2. The tensegrity unit of claim 2, wherein the unit is configured to be collapsed without adjusting the length of any of the n face tension members or any of the n continuous tension members.

3. The tensegrity unit of claim 1, wherein the unit is configured to be collapsed without freeing an end of any of the n face tension members or any of the n continuous tension members.

4. The tensegrity unit of claim 1, wherein the unit is configured to be deployed by adjusting a length of at least one of the compression members.

5. The tensegrity unit of claim 1, further comprising a length-adjusting device on at least one of the n compression members.

6. The tensegrity unit of claim 1, further comprising at least one structure-coupling device.

7. The tensegrity unit of claim 1, further comprising n stops, wherein each of the n stops is coupled to one of then continuous tension members.

8. The tensegrity unit of claim 1, wherein at least one of then compression members is configured to couple to another tensegrity unit.

9. The tensegrity unit of claim 1, further comprising at least one cover attachment for attaching a cover to the tensegrity unit.

10. The tensegrity unit of claim 1, further comprising a structure-coupling device coupled to at least one of the compression members, wherein the structure-coupling device is configured to couple the tensegrity unit to another tensegrity unit.

11. A tensegrity structure comprising:

at least two tensegrity units, each tensegrity unit comprising:

n face tension members of fixed length;

n continuous tension members affixed length;

n compression members; and wherein n is the number of sides of a polygonal face of a tensegrity unit of the tensegrity structure;

wherein a first tensegrity unit of the at least two tensegrity units is coupled to a second tensegrity unit of the at least two tensegrity units; and a cover coupled to the tensegrity structure.

12. The tensegrity structure of claim 11, wherein a continuous tension member of the first tensegrity unit is coupled to a face tension member of the second tensegrity unit.

13. The tensegrity structure of claim 11, wherein a continuous tension member of the first tensegrity unit is coupled to a continuous tension member of the second tensegrity unit.

14. A method of constructing a tensegrity structure, the method comprising:

assembling a stable cluster of tensegnty units; and coupling tensegrity units to at least one edge of the stable cluster of tensegrity units to form the tensegrity structure.

15. The method of claim 14, wherein the method further comprises incrementally adjusting the height of the tensegrity structure during construction.

16. The method of claim 14, wherein the method further comprises using at least one support to incrementally adjust the height of the tensegrity structure during construction.

17. The method of claim 14, wherein the method further comprises using at least one set of supports to incrementally adjust the height of the tensegrity structure during construction.

18. The method of claim 14, wherein the method further comprises coupling the tensegrity structure to at least one support.

19. The method of claim 14, wherein the method further comprises coupling the tensegrity structure to at least one support, and wherein the at least one support is expandable.

20. The method of claim 14, wherein the method further comprises coupling a covering to the tensegrity structure as the tensegrity structure is being assembled.

21. The method of claim 14, wherein the method further comprises coupling a covering to the tensegrity structure after the tensegrity structure is assembled.

22. A method of forming a tensegrity unit, comprising:

coupling n face tension members to first sections of n compression members to allow the face tension members to form a first polygonal face when the tensegrity unit is deployed;

coupling a continuous tension member of n continuous tension members to the first section of a compression member of the n compression members;

passing an end of a continuous tension member of the n continuous tension members through an opening in a bracket of n brackets, wherein one of the brackets is coupled to a second section of each of then compression members; and coupling ends of each continuous tension member to one of the brackets so that portions of the n continuous tension members form a second polygonal face when the tensegrity unit is deployed.

23. The method of claim 22, wherein each of the n continuous tension members comprises a stop, wherein a portion of each bracket is configured to inhibit passage of a stop, and wherein a portion of each bracket is configured to allow passage of a stop.

24. A method of forming a tensegrity unit, comprising:

positioning stops of continuous tension members in portions of brackets that inhibit passage of stops through the brackets, wherein the stops are coupled to the continuous tension members;

adjusting position of compression members to form a first polygonal face from face tension members; and adjusting a length of at least one of the compression members to apply tension to the continuous tension members.

25. A tensegrity unit comprising:

n face tension members;

n continuous tension members;

n compression members;

one or more brackets coupled to at least one of the n compression members;

a stop positioned along a length of at least one of the n continuous tension members, wherein at least one of the brackets inhibits passage of the stop through the bracket during use to establish tension in at least one of the n continuous tension members; and wherein n is the number of sides of a polygonal face of the tensegrity unit.

26. A tensegrity unit comprising:

at least one cover attachment for attaching a cover to the tensegrity unit;

n face tension members;

n continuous tension members;

n compression members;

wherein n is the number of sides of a polygonal face of the tensegrity unit; and wherein the tensegrity unit is configured to be deployed by adjusting a length of one of the compression members.

27. The tensegrity unit of claim 26, wherein the unit is configured to be collapsed without adjusting the length of any of then face tension members or any of the n continuous tension members.

28. The tensegrity unit of claim 26, wherein the unit is configured to be collapsed without freeing an end of any of the n face tension members or any of the n continuous members.

29. The tensegrity unit of claim 26, wherein at least one of the n compression members is configured to couple to another tensegrity unit.

30. The tensegrity unit of claim 26, further comprising a cover.

31. A tensegrity unit comprising:

n face tension members;

n continuous tension members;

n compression members;

wherein n is the number of sides of a polygonal face of the tensegrity unit; and at least one structure-coupling device.

32. The tensegrity unit of claim 31, wherein the unit is configured to be collapsed without adjusting the length of any of the n face tension members or any of the n continuous tension members.

33. The tensegrity unit of claim 31, wherein the unit is configured to be collapsed without freeing an end of any of then face tension members or any of the n continuous members.

34. The tensegrity unit of claim 31, wherein at least one of the n compression members is configured to couple to another tensegrity unit.

35. The tensegrity unit of claim 31, further comprising at least one cover attachment for attaching a cover to the tensegrity unit.

36. The tensegrity unit of claim 31, further comprising at least one cover attachment for attaching a cover to the tensegrity unit, and further comprising a cover.

37. A tensegrity unit comprising:

n face tension members;

n continuous tension members;

n compression members;

n stops, wherein each of the n stops is coupled to one of then continuous tension members; and wherein n is the number of sides of a polygonal face of the tensegrity unit.

38. A tensegrity unit comprising:

n face tension members;

n continuous tension members;

n compression members;

a structure-coupling device coupled to at least one of the compression members, wherein the structure coupling device is configured to couple the tensegrity unit to another tensegrity unit; and wherein n is the number of sides of a polygonal face of the tensegrity unit.

39. The method of claim 22, further comprising coupling the tensegrity unit with one or more additional tensegrity units to form a tensegrity structure, and incrementally adjusting the height of the tensegrity structure during construction.

40. The method of claim 22, further comprising coupling the tensegrity unit with one or more additional tensegnty units to form a tensegrity structure, and using at least one support to incrementally adjust the height of the tensegrity structure during construction.

41. The method of claim 22, further comprising coupling the tensegrity unit with one or more additional tensegrity units to form a tensegrity structure, and using at least one set of supports to incrementally adjust the height of the tensegrity structure.

42. The method of claim 22, further comprising coupling the tensegrity unit with one or more additional tensegrity units to form a tensegrity structure, and coupling the tensegrity structure to at least one support.

43. The method of claim 22, further comprising coupling the tensegrity unit with one or more additional tensegrity units to form a tensegrity structure, and coupling the tensegrity structure to one or more supports, wherein at least one of the supports is expandable.

44. The method of claim 22, further comprising coupling the tensegrity unit with one or more additional tensegrity units to form a tensegrity structure, and coupling a covering to the tensegrity structure as the tensegrity structure is being assembled.

45. The method of claim 22, further comprising coupling the tensegrity unit with one or more additional tensegrity units to form a tensegrity structure, and coupling a covering to the tensegrity structure after the tensegrity structure is assembled.

46. The method of claim 24, further comprising coupling the tensegrity unit with one or more additional tensegrity units to form a tensegrity structure, and incrementally adjusting the height of the tensegrity structure during construction.

47. The method of claim 24, further comprising coupling the tensegrity unit with one or more additional tensegrity units to form a tensegrity structure, and using at least one support to incrementally adjust the height of the tensegrity structure during construction.

48. The method of claim 24, further comprising coupling the tensegrity unit with one or more additional tensegrity units to form a tensegrity structure, and using at least one set of supports to incrementally adjust the height of the tensegrity structure.

49. The method of claim 24, further comprising coupling the tensegrity unit with one or more additional tensegrity units to form a tensegrity structure, and coupling the tensegrity structure to at least one support.

50. The method of claim 24, further comprising coupling the tensegrity unit with one or more additional tensegrity units to form a tensegrity structure, and coupling the tensegrity structure to one or more supports, wherein at least one of the supports is expandable.

51. The method of claim 24, further comprising coupling the tensegrity unit with one or more additional tensegrity units to form a tensegrity structure, and coupling a covering to the tensegrity structure as the tensegrity structure is being assembled.

52. The method of claim 24, further comprising coupling the tensegrity unit with one or more additional tensegrity units to form a tensegrity structure, and coupling a covering to the tensegrity structure after the tensegrity structure is assembled.

53. A tensegrity unit comprising:

n face tension members of fixed length;

n continuous tension members of fixed length;

n compression members;

a length adjusting device on at least one of the n compression members; and wherein n is the number of sides of a polygonal face of the tensegrity unit.

54. The tensegrity unit of claim 53, wherein the unit is configured to be collapsed without freeing an end of any of the n face tension members or any of the n continuous tension members.

55. The tensegrity unit of claim 53, wherein the unit is configured to be deployed by adjusting a length of at least one of the compression members.

56. The tensegrity unit of claim 53, further comprising at least one structure-coupling device.

57. The tensegrity unit of claim 53, further comprising n stops, wherein each of the n stops is coupled to one of the n continuous tension members.

58. The tensegrity unit of claim 53, wherein at least one of the n compression members is configured to couple to another tensegrity unit.

59. The tensegrity unit of claim 53, further comprising at least one cover attachment for attaching a cover to the tensegrity unit.

60. A tensegrity unit comprising:

n face tension members of fixed length;

n continuous tension members of fixed length;

n compression members;

at least one structure coupling device; and wherein n is the number of sides of a polygonal face of the tensegrity unit.

61. The tensegrity unit of claim 60, wherein the unit is configured to be collapsed without freeing an end of any of the n face tension members or any of the n continuous tension members.

62. The tensegrity unit of claim 60, wherein the unit is configured to be deployed by adjusting a length of at least one of the compression members.

63. The tensegrity unit of claim 60, further comprising n stops, wherein each of the n stops is coupled to one of the n continuous tension members.

64. The tensegrity unit of claim 60, wherein at least one of the n compression members is configured to couple to another tensegrity unit.

65. The tensegrity unit of claim 60, further comprising at least one cover attachment for attaching a cover to the tensegrity unit.

66. A tensegrity unit comprising:

n face tension members of fixed length;

n continuous tension members of fixed length;

n compression members;

n stops, wherein each of the n stops is coupled to one of the n continuous tension members; and wherein n is the number of sides of a polygonal face of the tensegrity unit.

67. The tensegrity unit of claim 66, wherein the unit is configured to be collapsed without adjusting the length of any of then face tension members or any of then continuous tension members.

68. The tensegrity unit of claim 66, wherein the unit is to be collapsed without freeing an end of any of the n face tension members or any of the n continous tension members.

69. The tensegrity unit of claim 66, wherein at least one of the n compression members is configured to couple to another tensegrity unit.

70. The tensegrity unit of claim 66, further comprising at least one cover attachment for attaching a cover to the tensegrity unit.

71. A tensegrity unit comprising:

n face tension members of fixed length;

n continuous tension members of fixed length;

n compression members;

at least one cover attachment for attaching a cover to the tensegrity unit; and wherein n is the number of sides of a polygonal face of the tensegrity unit.

72. The tensegrity unit of claim 71, wherein the unit is configured to be collapsed without adjusting the length of any of then face tension members or any of then continuous tension members.

73. The tensegrity unit of claim 71, wherein the unit is configured to be collapsed without freeing an end of any of the n face tension members or any of then continuous tension members.

74. The tensegrity unit of claim 71, wherein at least one of the n compression members is configured to couple to another tensegrity unit.

75. A tensegrity unit comprising:

n face tension members of fixed length;

n continuous tension members of fixed length;

n compression members;

a structure-coupling device coupled to at least one of the compression members, wherein the structure-coupling device is configured to couple the tensegrity unit to another tensegrity unit; and wherein n is the number of sides of a polygonal face of the tensegrity unit.

76. The tensegnty unit of claim 75, wherein the unit is configured to be collapsed without freeing an end of any of the n face tension members or any of the n continuous tension members.

77. The tensegrity unit of claim 75, wherein at least one of then compression members is configured to couple to another tensegrity unit.

* * * * *

UNITED STATES PATENT AND TRADEMARK OFFICE

CERTIFICATE OF CORRECTION

PATENT NO. : 6,901,714 B2
DATED : June 7, 2005
INVENTOR(S) : Katherine A. Liapi

It is certified that error appears in the above-identified patent and that said Letters Patent is hereby corrected as shown below:

Column 12,
Line 30, please delete "claim 2" and substitute therefor -- claim 1 --.
Line 46, please delete "of then" and substitute therefor -- of the *n* --.

Column 13,
Line 52, please delete "of then" and substitute therefor -- of the *n* --.

Column 14,
Line 33, please delete "of then" and substitute therefor -- of the *n* --.
Line 57, please delete "then" and substitute therefor -- the *n* --.

Column 15,
Line 6, please delete "then" and substitute therefor -- the *n* --.
Line 25, please delete "tensegnty" and substitute therefor -- tensegrity --.

Column 17,
Line 15, please delete "of then face" and "of then continuous" and substitute therefor -- of the *n* face -- and -- of the *n* continuous --.

Column 18,
Line 9, please delete "then" and substitute therefor -- the *n* --.
Line 24, please delete "tensegnty" and substitute therefor -- tensegrity --.

Signed and Sealed this

Sixth Day of December, 2005

JON W. DUDAS
*Director of the United States Patent and Trademark Office*